US005411441A

United States Patent [19]

Detka

[11] Patent Number: 5,411,441

[45] Date of Patent: May 2, 1995

[54] POOL CUE WITH SPRING LOADED TIP

[76] Inventor: Albert S. Detka, 1304 - 4th St., Beaver Falls, Pa. 15010

[21] Appl. No.: 265,775

[22] Filed: Jun. 27, 1994

[51] Int. Cl.[6] ..... A63D 15/08

[52] U.S. Cl. ..... 473/44; 473/49

[58] Field of Search ..... 473/44, 45, 46, 48, 473/49, 51; 273/129 R, 129 S, 78; 135/82, 83

[56] References Cited

U.S. PATENT DOCUMENTS 1,512,554 10/1924 Magono ..... 473/49

FOREIGN PATENT DOCUMENTS 418564 7/1910 France ..... 473/45

2918557 11/1980 Germany ..... 473/45

257159 8/1926 United Kingdom ..... 473/49

*Primary Examiner*—Vincent Millin

*Assistant Examiner*—William M. Pierce

*Attorney, Agent, or Firm*—John P. Halvonik

[57] ABSTRACT

The invention is an improved pool cue with a spring loaded tip is mounted in a hollowed out portion at the front of the cue or stick and is freely movable forward and backward within the confines of the hollowed out portion. A spring biases the tip to the back of the hollowed out portion and allows for the tip to be compressed at the moment of striking the ball. The area where the spring is mounted is encased in silicone for further compressibility.

2 Claims, 1 Drawing Sheet

POOL CUE WITH SPRING LOADED TIP

BACKGROUND AND FIELD OF THE INVENTION

The invention relates to the field of billiard cues and, in particular, to a spring biased cue where the tip is biased against the front of the cue stick. The spring within the tip is encased in silicone and is fixed within the hollowed out portion at the front of the tip. The tip will travel forward and backward within the hollowed out portion of the cue stick.

PRIOR ART

While there are cue sticks that have springs at the front of the cue, there are none that applicant is aware of that allow for the free travel of the tip forward and backward within the hollowed out tip. Such patents as U.S. Pat. No. 1,495,842 to Gulfi et al. have e.g. a fixed screw which prevents the tip from free travel. There are also no known tips that applicant is aware of that encase the spring in silicone in order to prevent damage to the cue stick and/or the tip when the tip is pushed backward upon the striking of the ball with the tip. The silicone also prevents the tip from coming out of the hollowed out portion due the action of the spring.

SUMMARY OF THE INVENTION

The invention is an improved pool cue with a spring loaded tip. The tip is mounted in a hollowed out portion at the front of the cue or stick and is freely movable forward and backward within the confines of the hollowed out portion. A spring connects the tip and biases it in relation to the back of the hollowed out portion. The spring compresses at the moment the ball is struck with the tip. The action of the spring and surrounding silicone provide added momentum in addition to that of the stick that is delivered to the ball upon impact. The area where the spring is mounted is encased in silicone for further compressibility.

It is among the objects of the invention to provide a spring biased tip for a billiard cue stick that will provide extra force upon striking a ball due to the compressive nature of the spring action.

Another objective is to provide a billiard cue to deliver a compressive force onto a ball through the action of a spring biased tip and to allow for greater "English" to be delivered to the ball upon striking with the tip by virtue of the tip remaining in contact with the ball for a longer time period upon striking.

Another objective is to provide a spring loaded billiard cue that allows the tip to freely travel forward and backward in order to deliver compressive force.

Another objective is to provide a billiard cue with a spring loaded tip with a spring that is encased in silicone in order to prevent the spring from coming out of the tip during repeated play and to prevent the damage to the cue stick or the tip upon impact.

Another objective is to provide a spring loaded cue with a means to deliver a compressive force that will be enhanced by encasing the spring in silicone.

Other objectives of the invention will be readily apparent to those skilled in the art once the invention has been described.

DESCRIPTION OF THE PREFERRED EMBODIMENT

Figure 1:
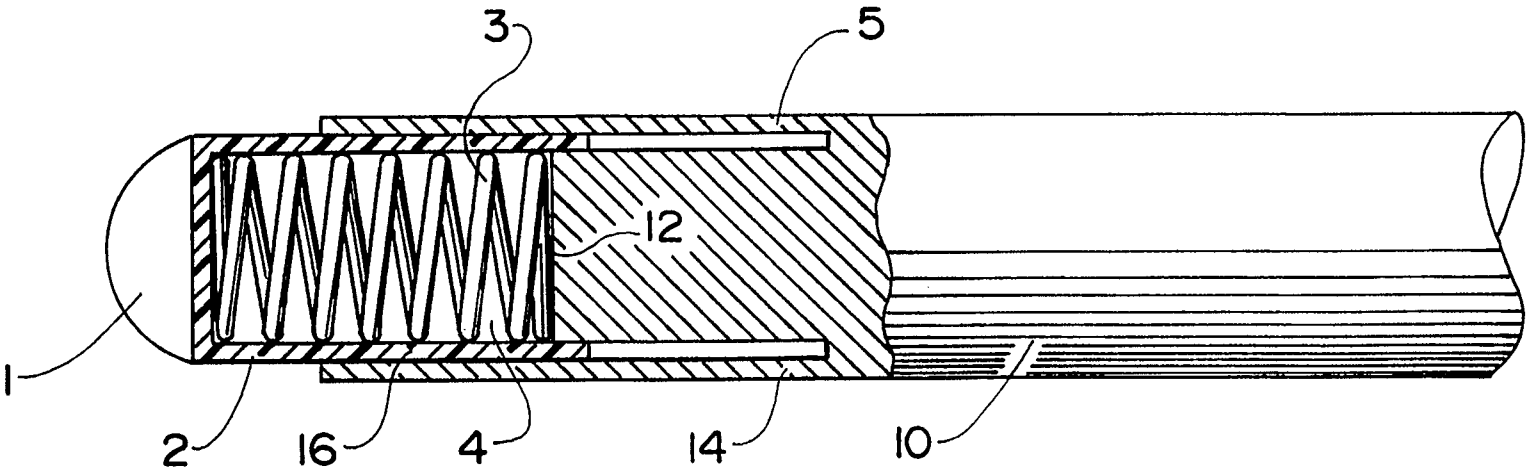
FIG. 1 Overall construction of the tip.

There is a hollowed out portion at the front 5 of the cue stick 10. The tip 1 and spring 3 assembly are placed in this space. This hollowed out portion may simply be a cylindrical shaped space at the front of the shaft with a projecting portion 12 in the center of the hollowed out space. The projecting portion may be of circular cross section. Thus, there will be a narrow space between the outer wall 14 of the stick and this projecting portion 12. For purposes of discussion, the term "stick" does not include the spring biased tip attached to the front of the stick.

The hollowed out portion could also be constructed as an attachable piece (or metal, plastic, etc.) that is constructed in similar manner and may then be attached at the front of the cue. The walls of the hollowed out portion will be, preferably, circular in shape.

The tip 1 attached to the front of the stick may be said resemble a piston. This tip should be of appropriate size for billiards and should fit comfortably within the confines of the hollowed out portion. The tip may have a hollow cross section formed by a rear wall 2 in order to accommodate a spring 3 attached to the interior of this hollow space in the tip.

The front end of the spring may be attached to the backside of the tip and the rear of the spring may be attached to the front of the central portion at 12. The tip could also have an aperture for attachment of the spring. Other means for attaching the spring to the tip and the stick may also be used.

The side wall 16 of the tip may be of circular cross section and should be able to fit in between the outer wall 14 and the central portion 12. The wall 16 can travel within this space and allows the tip to freely move backward and forward in relation to the cue stick.

Silicone 4 should be placed around the spring and inside the hollowed out portion at the rear of the tip. This should be done during the construction of the tip. The silicone will be between the front of the tip and the front of the stick at 12. The silicone should not be inside the space between walls 16 and 14 as this would hinder the travel of the piston.

The use of this silicone will prevent damage to the tip and/or the front of the stick by the forcing back of the tip upon contact with the ball. The silicone will also aid in keeping the spring from coming out of the hollowed out portion as it is released.

The tip may be made of any available state of the art materials that are appropriate for such tips, such as wood, hardened plastic, or possibly metals. The cue stick will be made of appropriate materials such as wood, etc.

I claim:

1. An improved billiard cue comprising: a shaft having a front end and a back end, said front end having an outer wall extending from a point near said front end of said shaft to a point forward of said shaft, said outer wall about parallel to said front end so as to create a narrow space between said outer wall and said front end and an enclosed space forward of said front end, a tip having a back side and a rear wall extending from said back side so as to form a small space enclosed by said back side and said rear wall, a biasing means in connection with said back end, said rear wall of size adapted to slide within said enclosed space and said narrow space, a silicone substance located in said small space and in connection with said biasing means.

2. The apparatus of claim 1 wherein said biasing means is a spring.

* * * * *